US009581036B2

(12) United States Patent
Pal et al.

(10) Patent No.: US 9,581,036 B2
(45) Date of Patent: Feb. 28, 2017

(54) SEAL SYSTEM INCLUDING ANGULAR FEATURES FOR ROTARY MACHINE COMPONENTS

(71) Applicant: General Electric Company, Schenectady, NY (US)

(72) Inventors: Dipankar Pal, Greenville, SC (US); Robert Walter Coign, Piedmont, SC (US); Gary Michael Itzel, Simpsonville, SC (US); Kevin Thomas McGovern, Simpsonville, SC (US); Christopher Donald Porter, Greenville, SC (US)

(73) Assignee: General Electric Company, Schenectady, NY (US)

( * ) Notice: Subject to any disclaimer, the term of this patent is extended or adjusted under 35 U.S.C. 154(b) by 961 days.

(21) Appl. No.: 13/893,729

(22) Filed: May 14, 2013

(65) Prior Publication Data

US 2014/0341720 A1 Nov. 20, 2014

(51) Int. Cl.
*F01D 11/00* (2006.01)

(52) U.S. Cl.
CPC ..... *F01D 11/005* (2013.01); *F01D 11/006* (2013.01); *F05D 2240/57* (2013.01)

(58) Field of Classification Search
CPC ..... F01D 11/005; F01D 11/006; F01D 5/10; F01D 5/16; F01D 5/26; F01D 25/14; F01D 25/26; F05D 2240/57; F05D 2240/11
See application file for complete search history.

(56) References Cited

U.S. PATENT DOCUMENTS

| | | | | |
|---|---|---|---|---|
| 4,767,260 | A * | 8/1988 | Clevenger | F01D 11/005 415/115 |
| 4,902,198 | A * | 2/1990 | North | F01D 9/04 415/115 |
| 5,531,457 | A | 7/1996 | Tibbott et al. | |
| 5,975,844 | A | 11/1999 | Milazar et al. | |
| 6,270,311 | B1 * | 8/2001 | Kuwabara | F01D 11/005 415/110 |
| 6,340,285 | B1 | 1/2002 | Gonyou et al. | |
| 7,163,376 | B2 | 1/2007 | Itzel et al. | |
| 2009/0116953 | A1 * | 5/2009 | Spangler | F01D 5/081 415/115 |

* cited by examiner

*Primary Examiner* — Nathaniel Wiehe
*Assistant Examiner* — Adam W Brown
(74) *Attorney, Agent, or Firm* — Ernest G. Cusick; Hoffman Warnick LLC

(57) ABSTRACT

Systems and devices configured to seal interfaces/gaps between stationary components of turbines and manipulate a flow of coolant about portions of the turbine during turbine operation are disclosed. In one embodiment, a seal element includes: a first surface shaped to be oriented toward a pressurized cavity of the turbine; a second surface oriented substantially opposite the first surface and shaped to sealingly engage a contact surface of the static components; and a first set of angular features disposed in the second surface, the first set of angular features fluidly connecting the pressurized cavity and the flowpath of the turbine.

17 Claims, 9 Drawing Sheets

SEAL SYSTEM INCLUDING ANGULAR FEATURES FOR ROTARY MACHINE COMPONENTS

FIELD OF THE INVENTION

The subject matter disclosed herein relates to rotary machines and, more particularly, to systems and devices for sealing interfaces/gaps between stationary components of turbines and manipulating a flow of coolant about portions of the turbine during turbine operation.

BACKGROUND OF THE INVENTION

Some power plant systems, for example certain nuclear, simple cycle and combined cycle power plant systems, employ turbines in their design and operation. Some of these turbines are driven by a flow of high temperature working fluid (e.g., steam, gas, etc.) which is directed over and/or through a series of stages and components (e.g., alternating stationary and rotary airfoils/buckets/blades) within the turbine to generate power. These components and stages may be located at close proximity (e.g., small clearances) relative to one another so as to decrease working fluid leakage through the system and improve turbine efficiency.

In some systems, working fluid may be contained within the flowpath and leaks reduced by passing a pressurized cooling fluid (e.g., compressor air) about the flowpath which is contained by a set of seals. Direct leakage of the pressurized cooling fluid into the flowpath and/or of the working fluid out of the turbine may reduce turbine efficiency and component and turbine lifespan. However, as a result of the high temperatures of the working fluid during operation, components (e.g., stators, blades, shells, etc.) may experience a significant increase in temperature, often rising across a temperature range of hundreds of degrees Celsius and resulting in thermal expansion which may require clearances between components which may cause leakage. As a result, some systems locate seals between segmented static turbine components (e.g., stator shells, shrouds, nozzles, gas path components, etc.). In most systems these seals are located away from the flowpath of the working fluid so as to reduce/limit exposure of the seal to the thermal extremes of the working fluid. This location however requires additional purge air to cool down the inter-segment chute region. Some other systems locate the seal at a closer proximity to the gas path, as a result these seals require active surface cooling to thermally withstand the impact of the hot working fluid flow proximate the seal surface. These seals may limit turbine design and operation, by requiring a large amount of coolant flow into the turbine system and subsequent leakage into the flowpath, thereby reducing turbine efficiency.

BRIEF DESCRIPTION OF THE INVENTION

Systems and devices for sealing interfaces/gaps between stationary components of turbines and manipulate a flow of coolant about portions of the turbine during turbine operation are disclosed. In one embodiment, a seal element includes: a first surface shaped to be oriented radially outboard relative to a flowpath of the turbine, the first surface facing a pressurized cavity of the turbine; a second surface oriented substantially opposite the first surface and shaped to sealingly engage a contact surface of the static components; and a first set of angular features disposed in the second surface, the first set of angular features fluidly connecting the pressurized cavity and the flowpath of the turbine.

A first aspect of the disclosure provides a seal element including: a first surface shaped to be oriented radially outboard relative to a flowpath of the turbine, the first surface facing a pressurized cavity of the turbine; a second surface oriented substantially opposite the first surface and shaped to sealingly engage a contact surface of the static components; and a first set of angular features disposed in the second surface, the first set of angular features fluidly connecting the pressurized cavity and the flowpath of the turbine.

A second aspect provides a power generation system including: a turbine including: a first static component disposed between a pressurized cavity of the turbine and a working fluid flowpath of the turbine; a second static component disposed adjacent the first static component and between the pressurized cavity of the turbine and the working fluid flowpath of the turbine; and a seal element shaped to be disposed between the first static component and the second static component, the seal element including: a first surface shaped to be oriented radially outboard relative to the working fluid flowpath of the turbine, the first surface facing the pressurized cavity of the turbine; a second surface oriented substantially opposite the first surface and shaped to sealingly engage a contact surface of the first static component and the second static component; and a first set of angular features disposed in the second surface, the first set of angular features fluidly connecting the pressurized cavity and the working fluid flowpath of the turbine.

A third aspect provides a turbine including: a stator including a first static component and a second static component, the first static component and the second static component disposed radially inboard of a pressurized cavity; a working fluid passage substantially surrounded by the stator; a rotor configured radially inboard of the working fluid passage; and a seal element shaped to be disposed between the first static component and the second static component, the seal element including: a first surface shaped to be oriented radially outboard relative to the working fluid passage of the turbine; a second surface oriented substantially opposite the first surface and shaped to sealingly engage a contact surface of the first static component and the second static component; and a first set of angular features disposed in the second surface, the first set of angular features fluidly connecting the pressurized cavity and the working fluid passage of the turbine.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
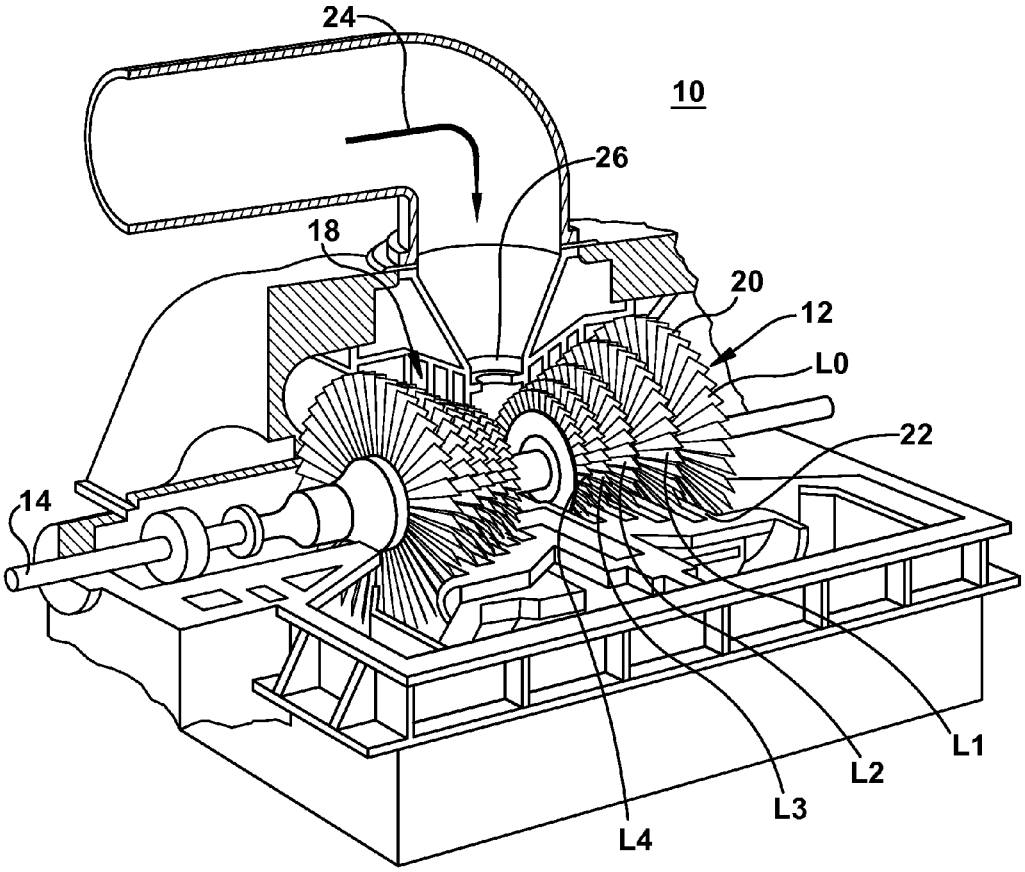
FIG. 1 a three-dimensional partial cut-away perspective view of a portion of a turbine.

It is noted that the drawings of the disclosure are not necessarily to scale. The drawings are intended to depict only typical aspects of the disclosure, and therefore should not be considered as limiting the scope of the disclosure. It is understood that elements similarly numbered between the FIGURES may be substantially similar as described with reference to one another. Further, in embodiments shown and described with reference to FIGS. 1-11, like numbering may represent like elements. Redundant explanation of these elements has been omitted for clarity. Finally, it is understood that the components of FIGS. 1-11 and their accompanying descriptions may be applied to any embodiment described herein.

DETAILED DESCRIPTION OF THE INVENTION

As indicated above, aspects of the invention provide for seal systems and devices configured to seal interfaces/gaps between static/stationary components (e.g., stators, shrouds, nozzles, gas path components, etc.) of turbines during turbine operation and manipulate a flow of coolant about portions of the turbine. The system includes a seal element (e.g., a seal strip, a root seal strip, an inter-segment seal, etc.) disposed at an interface between a first static component and a second static component. In an embodiment, the first static component and the second static component may be disposed adjacent one another with an interface gap separating the two components. The first and second static components may each include a channel disposed in an interface surface (e.g., a surface which faces the interface gap between the two components) of the components. The seal element may be shaped to be disposed within these channels, extending into a portion of the channel in each component and thereby forming a barrier/seal across the interface gap.

During operation the seal element may be pressed against a surface of the channel by a pressurized coolant flow which creates a pressure difference across the seal element. The seal element may include a set of angular features (e.g., discrete or repetitive patterns/channels/grooves) formed in a surface of the seal element. The set of angular features may be shaped to form a passage between the pressurized coolant flow and the working fluid flow path, the passage shaped to channel/direct/manipulate a flow of the pressurized coolant flow (e.g., control leakage from the pressurized cavity to the interface gap region next to the flowpath). In one embodiment, a portion of the pressurized coolant flow may pass through the set of angular features, traveling from the pressurized cooler side of the seal element into the flowpath of the turbine. As a result, the sealing element may substantially seal the interface and be thermally regulated by the pressurized coolant flow which may be controllably leaked into the flowpath after having been heated (e.g., by flowing near a hot gas environment/the working fluid flowpath). Further, in one embodiment, the angular features may be shaped to accelerate the flow of pressurized coolant into regions where the adjacent turbine components experience increased heat fluxes/inputs from the working fluid flow path gas stream. This may reduce the necessary height of the interface gap region and decrease the coolant flow requirements for effective control of the temperature of hot gases in the interface gap region.

Turning to the FIGURES, embodiments of systems and devices are shown, which are configured to seal interfaces/gaps between stationary components of turbines and manipulate a flow of coolant about portions of the turbine during turbine operation, these systems improving turbine performance. Each of the components in the FIGURES may be connected via conventional means, e.g., via a common conduit or other known means as is indicated in FIGS. 1-11. Referring to the drawings, FIG. 1 shows a perspective partial cut-away illustration of a gas or steam turbine 10. Turbine 10 includes a rotor 12 that includes a rotating shaft 14 and a plurality of axially spaced rotor wheels 18. A plurality of rotating blades 20 are mechanically coupled to each rotor wheel 18. More specifically, blades 20 are arranged in rows that extend circumferentially around each rotor wheel 18. A plurality of stationary vanes 22 extend circumferentially around shaft 14, and the vanes are axially positioned between adjacent rows of blades 20. Stationary vanes 22 cooperate with blades 20 to form a stage and to define a portion of a steam (or gas) flow path through turbine 10.

In operation, gas or steam 24 enters an inlet 26 of turbine 10 and is channeled through stationary vanes 22. Vanes 22 direct gas or steam 24 downstream against blades 20. Gas or steam 24 passes through the remaining stages imparting a force on blades 20 causing shaft 14 to rotate. At least one end of turbine 10 may extend axially away from rotating shaft 12 and may be attached to a load or machinery (not shown) such as, but not limited to, a generator, and/or another turbine.

In one embodiment, turbine 10 may include five stages. The five stages are referred to as L0, L1, L2, L3 and L4. Stage L4 is the first stage and is the smallest (in a radial direction) of the five stages. Stage L3 is the second stage and is the next stage in an axial direction. Stage L2 is the third stage and is shown in the middle of the five stages. Stage L1 is the fourth and next-to-last stage. Stage L0 is the last stage and is the largest (in a radial direction). It is to be understood that five stages are shown as one example only, and each turbine may have more or less than five stages. Also, as will be described herein, the teachings of the invention do not require a multiple stage turbine.

Figure 2:
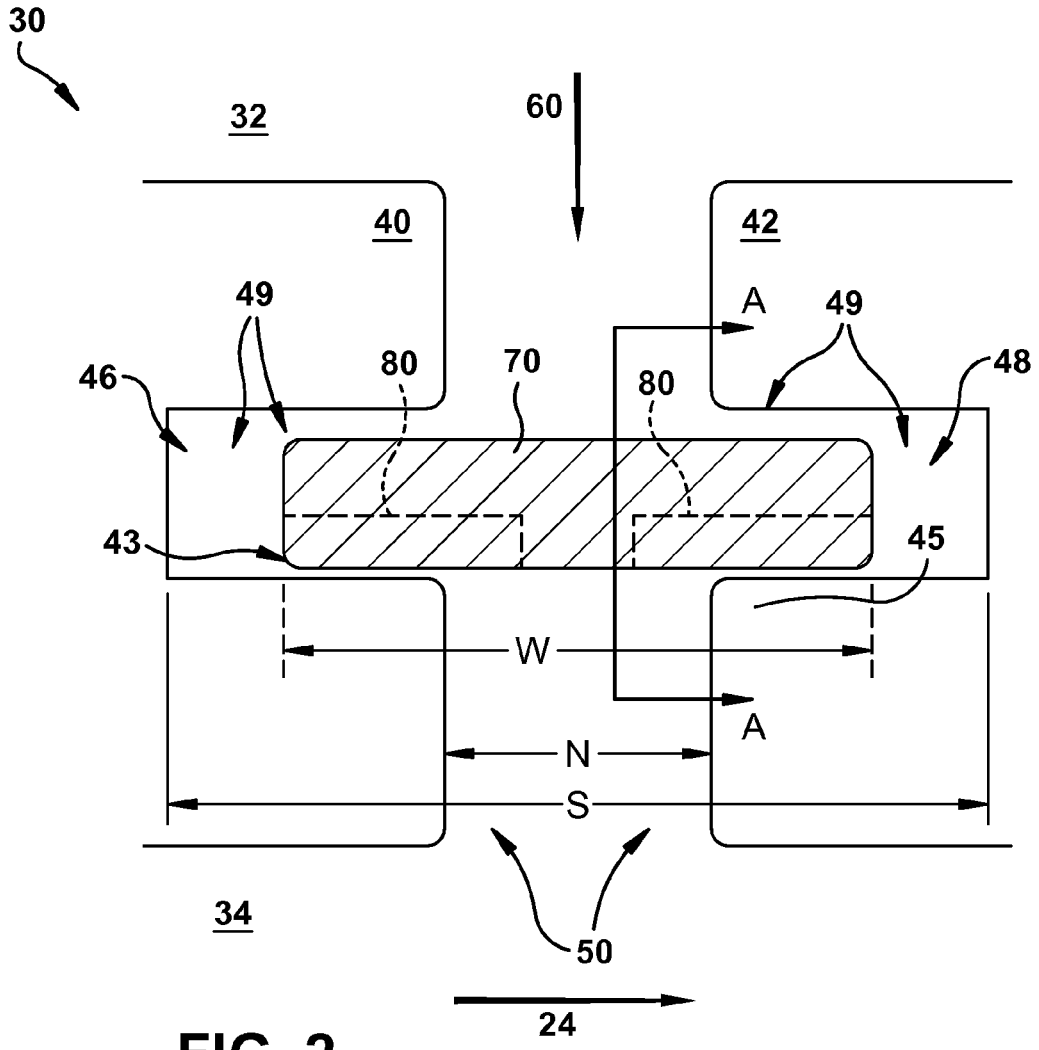
FIG. 2 shows a partial cross-sectional view of a seal assembly disposed between turbine components according to an embodiment of the invention.

Turning to FIG. 2, a partial cross-sectional view of a seal assembly 30 including a seal element 70 disposed proximate a working fluid flowpath of the turbine across an interface gap 50 between a first turbine component 40 and a second turbine component 42 is shown in accordance with an embodiment of the invention. First turbine component 40 includes a first channel 46 and second turbine component 42 includes a second channel 48 which may be substantially aligned with first channel 46 across interface gap 50. In an embodiment, first channel 46 and second channel 48 may substantially define a slot 49 across interface gap 50. Seal element 70 may be shaped to fit within slot 49 and extend across interface gap 50. In one embodiment, seal element 70 may have a width 'W' which is greater than a width 'N' of interface gap 50 but which is less than or equal to a width 'S' of slot 49 defined by first channel 46 and second channel 48 and width 'N'. During operation, a first portion (e.g., a pressurized cavity) 32 of turbine 10 exterior to components 40 and 42, and seal element 70, may be exposed to a pressurized coolant flow 60, and a second portion (e.g., a working fluid flowpath) 34 of turbine 10 interior to components 40 and 42, and seal element 70 may be exposed to a high temperature working fluid flow 24. Pressurized coolant flow 60 may have a pressure which is greater than the pressure of high temperature working fluid flow 24, thereby creating a pressure gradient across seal element 70 and forcing seal element 70 to contact a first surface 43 on first turbine component 40 and a second surface 45 on second turbine component 42. In an embodiment, the contact of seal element 70 on surfaces 43 and 45 may substantially seal interface gap 50. Seal element 70 may include a set of angular features 80 (shown in phantom) which may fluidly connect first portion 32 of turbine 10 and second portion 34 of turbine 10.

In an embodiment, set of angular features 80 may be shaped to pass a portion of pressurized coolant flow 60 between seal element 70 and turbine components 40 and 42, the portion of pressurized coolant flow 60 entering second portion 34 of turbine 10. In this embodiment, set of angular features 80 may provide a controlled path for leakage between the pressurized cavity 32 and into second portion 34. Set of angular features 80 may be angled to complement a flow through interface gap 50/second portion 34 and/or to increase a path/length of contact between pressurized coolant flow 60 and seal element 70. This increased exposure increasing time for heat to transfer in to pressurized coolant flow 60 before exhaust in to the interface gap 50 and mixing with fluid in second portion 34.

In an embodiment, set of angular features 80 may be shaped to accelerate the flow of pressurized coolant within the feature, thereby enhancing cooling of both seal element 70 and turbine components 40 and 42. Increased length and/or area of set of angular features 80 may increase cooling of seal element 70 and components 40 and 42, and heating of pressurized coolant flow 60 prior to introduction into second portion 34 by increasing exposure. In one embodiment, a portion of pressurized coolant flow 60 which passes through set of angular features 80 may cool seal element 70 and as a result be heated by thermal energy obtained from seal element 70 and components 40 and 42 prior to entering second portion 34. Set of angular features 80 may include discrete and/or repetitive patterns of features (e.g, channels, grooves, apertures, etc.). In one embodiment, set of angular features 80 may be located at specific locations on seal element 70 in order to cool turbine components 40 and 42, and may include a set of intermittent grooves. In an embodiment, seal element 70 may function as a damper and/or as a seal (e.g., resistance to relative motion between turbine components 40 and 42) between turbine components 40 and 42.

Figure 3:
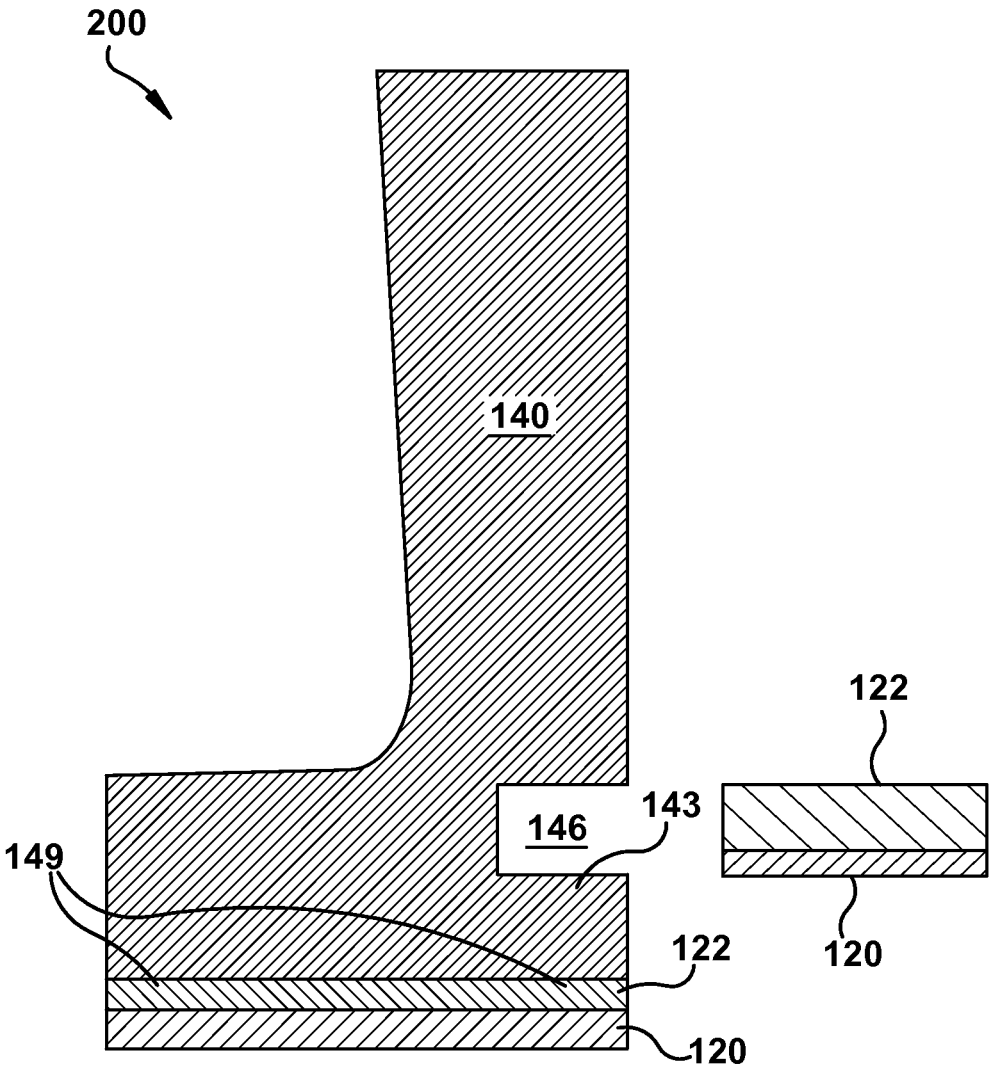
FIG. 3 shows a partial cross-sectional view of a turbine component according to an embodiment of the invention.

Turning to FIG. 3, a turbine component 140 is shown including a channel 146 shaped to complement seal element 70 in accordance with embodiments of the invention. Channel 146 may include/define a contact surface 143 configured to contact and/or sealingly engage seal element 70. In an embodiment, turbine component 140 may include a thermal barrier coating 120 connected to a flow path/high temperature surface 149 via a bond coat 122. In one embodiment, seal element 70 may include thermal barrier coating 120 and/or bond coat 122 (e.g., to protect/reinforce set of angular features 80). The thermal barrier coating may include ceramics or other insulative materials.

Figure 4:
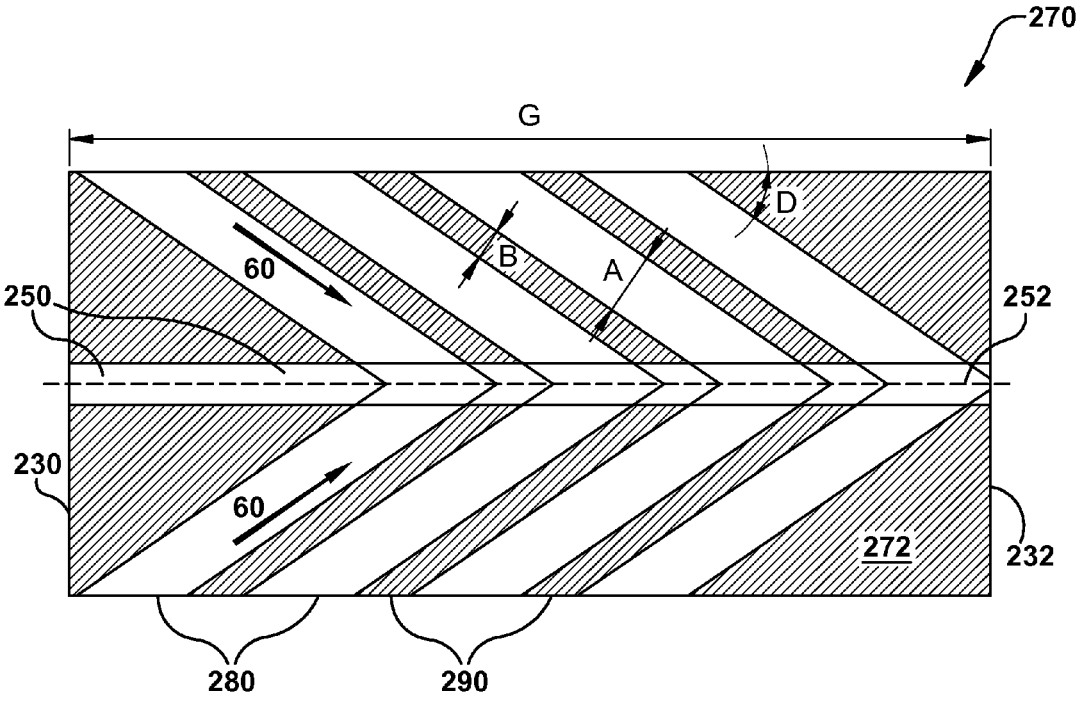
FIG. 4 shows a top view of a seal element according to an embodiment of the invention.

Turning to FIG. 4, a seal element 270 is shown including a set of angled features 280 disposed between a first edge 230 and a second edge 232 in accordance with embodiments of the invention. Set of angled features 280 may be formed in a flowpath surface 272 (e.g., a surface oriented toward/facing the working fluid flowpath of a turbine, a high temperature facing surface, etc.) of seal element 270 and may be substantially defined by a set of seal ridges 290 which are disposed substantially planar relative to flowpath surface 272 and configured to sealingly engage contact surface 143 (shown in FIG. 3). During operation, pressurized coolant flow 60 may pass/flow through set of angled features 280 to an interface gap surface 250 (e.g., a portion of flowpath surface 272 not contacting a turbine component, the portion of seal element 270 spanning the gap between two turbine components, etc.). In one embodiment, interface gap surface 250 may be exposed/fluidly contact the flowpath of the turbine and pressurized coolant flow 60 may enter the flowpath at this interface gap surface 250. Set of angled features 280 may be oriented about a centerline 252 of seal element 270.

As can be seen in FIG. 4, set of seal ridges 290 may have a width 'B' which is less than a width 'A' of set of angled features 280. In one embodiment, seal ridges 290 may have a width of about 0.03 inches and set of angled features 280 may have a width of about 0.06 inches. In an embodiment, set of angled features 280 may be oriented at an angle 'D' relative to the flow direction in the working fluid flowpath. In one embodiment, angle 'D' may be oriented at about 30 degrees relative to the flow of working fluid through the turbine flowpath and/or interface gap surface 250. Seal element 270 may have a length 'G' which is substantially longer than width A of set of angled features 280. In one embodiment, length G may be about 1 inch. In an embodiment, seal ridges 290 may have a finite thickness defined as a distance between the seal contact plane and a non-contacting face of angular feature 280. In one embodiment, finite thickness may be between about 0.1 inches and about 0.05 inches. It is understood that while specific angles, proportions, orientations, and/or configurations are shown herein, that any combination and/or configuration of angled features may be included in accordance with embodiments of the invention.

Figure 5:
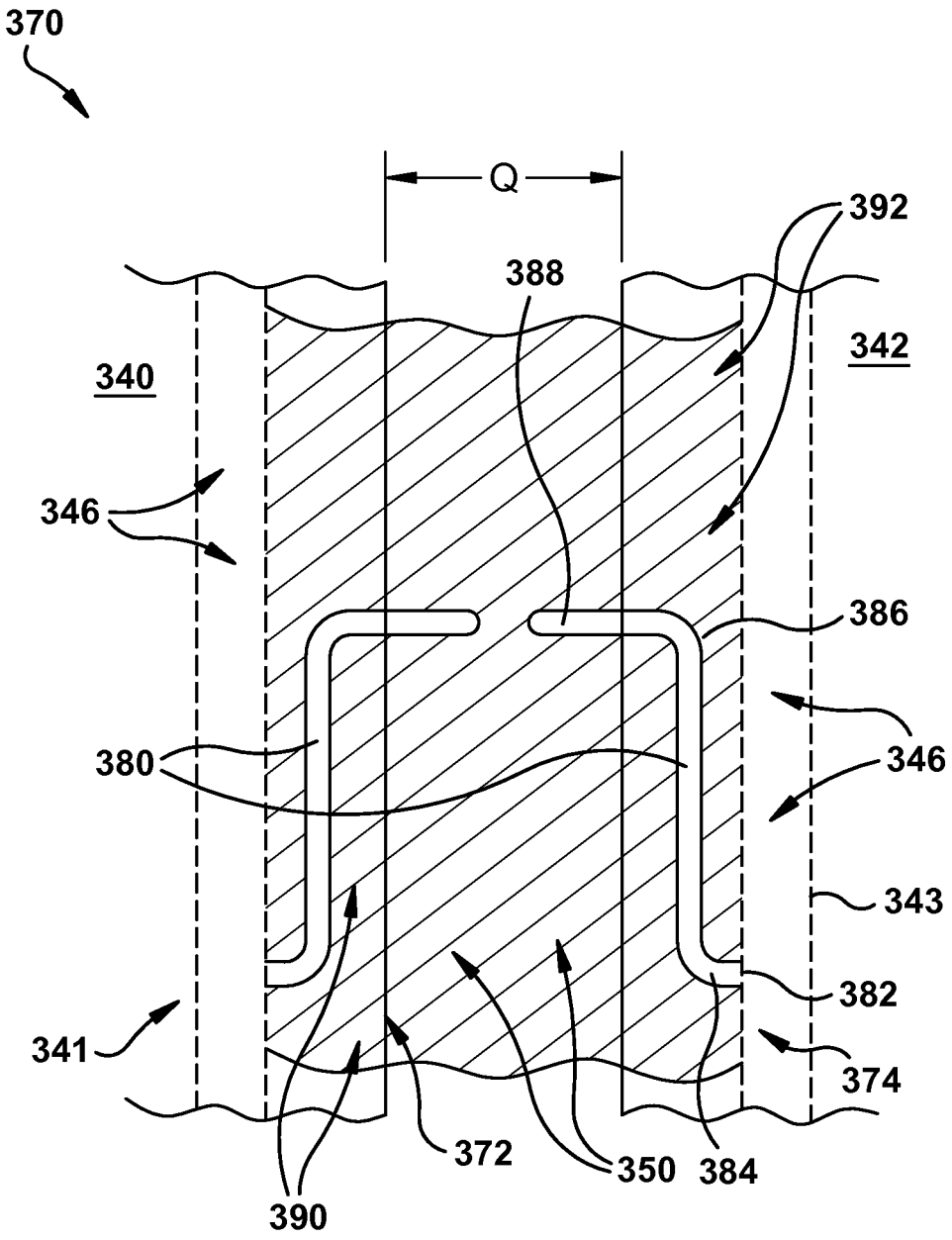
FIG. 5 shows a partial cross-sectional view of a seal element disposed between turbine components in accordance with an embodiment of the invention.

Turning to FIG. 5, a seal element 370 is shown disposed across an interface 350 between a first turbine component 340 and a second turbine component 342 in accordance with an embodiment of the invention. Seal element 370 may include a set of angled features 380 which may extend between an interface gap 350 between components 340 and 342, and a set of channels 346 and 348 (shown in phantom) disposed in components 340 and 342. Set of angled features 380 may fluidly connect portions of a turbine disposed on opposite sides of seal element 370 (e.g., connecting a pressurized coolant path with a working fluid flowpath of a turbine). In an embodiment, set of angled features 380 may include an entrance channel 382, a first angled portion 384, a second angled portion 386, and an exit channel 388. During operation, pressurized coolant flow 60 may pass through an angled feature 380 by entering entrance channel 382, flowing through angled portions 384 and 386, and entering the working fluid flowpath through exit channel 388 and interface gap 350. Exit channel 388 may extend beyond a gap edge surface 372 of turbine components 340 and 342, and entrance channel may extend to an outer edge surface 374 of seal element 370. Angled portions 384 and 386 may include any angular orientation relative to one another and/or the flow direction of working fluid in the flowpath.

Interface gap 350 may have a width 'Q' as determined by spacing between a first interface surface 390 of first turbine component 340 and a second interface surface 392 of second turbine component 342. It is understood that the orientation and/or direction of entrance channel 382 and exit channel 388 with respect to flow direction through interface gap 350 is merely illustrative and that any orientation and/or direction may be included in embodiments of the invention.

Figure 6:
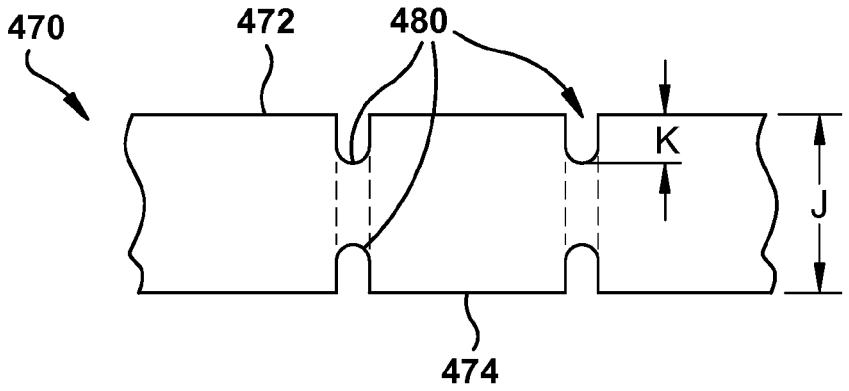
FIGS. 6-8 show a side views of embodiments of a seal element including angled features in accordance with embodiments of the invention.
Figure 7:
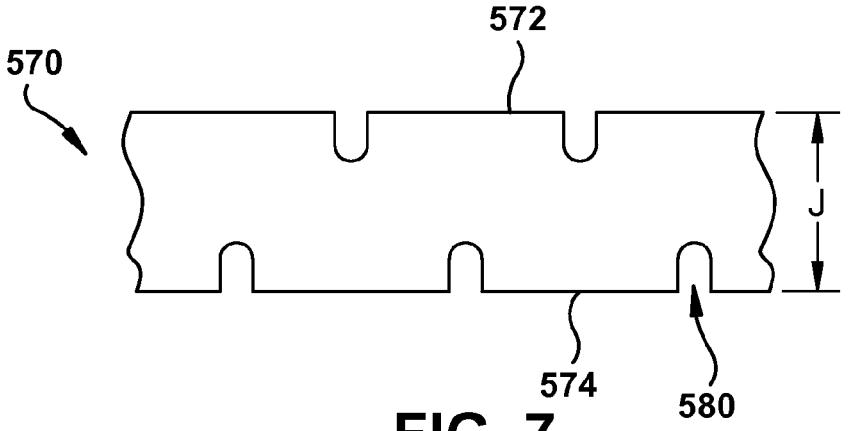
Figure 8:
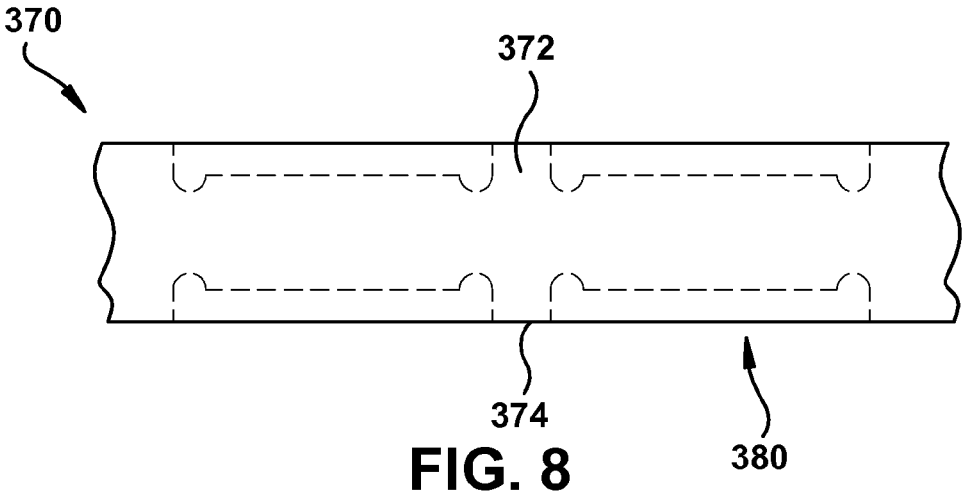

Turning to FIG. 6, a side view of a seal element 470 is shown including a set of angled features 480 in accordance with an embodiment of the invention. As can be seen in FIG. 6, seal element 470 may include a plurality of angled features 480 formed as a set of grooves/channels in a first surface 472 (e.g., a sealing side) and/or a second surface 474 (e.g., a non-sealing side) of seal element 470. In an embodiment, plurality of angled features may be formed on both surfaces 472 and 474 in a symmetric pattern. Plurality of angled features 480 may have a depth 'K' which is substantially less than a thickness 'J' of seal element 470. Turning to FIG. 7, a side view of a seal element 570 is shown including a set of angled features 580 in accordance with an embodiment of the invention. In this embodiment, set of angled features 580 are disposed in a first surface 572 and a second surface 574 in a staggered fashion. As can be seen in FIGS. 6-8, set of angled features 380, 480, and/or 580, may be disposed in both a working fluid facing side (e.g., a sealing side) and a coolant fluid facing side (e.g., a non-sealing side) of seal elements 370, 470, 570, or other seal element embodiments described herein. In an embodiment, patterns/orientations of angled features 580 may vary on sides enabling operators to flip seal element 570 for different operational/cooling characteristics based on turbine parameters. Turning to FIG. 8, a side view of seal element 370 is shown including set of angled features 380 in accordance with an embodiment of the invention. In this embodiment, angled features 380 are formed in both a coolant facing surface 372 and a working fluid facing surface 374 of seal element 370.

Figure 9:
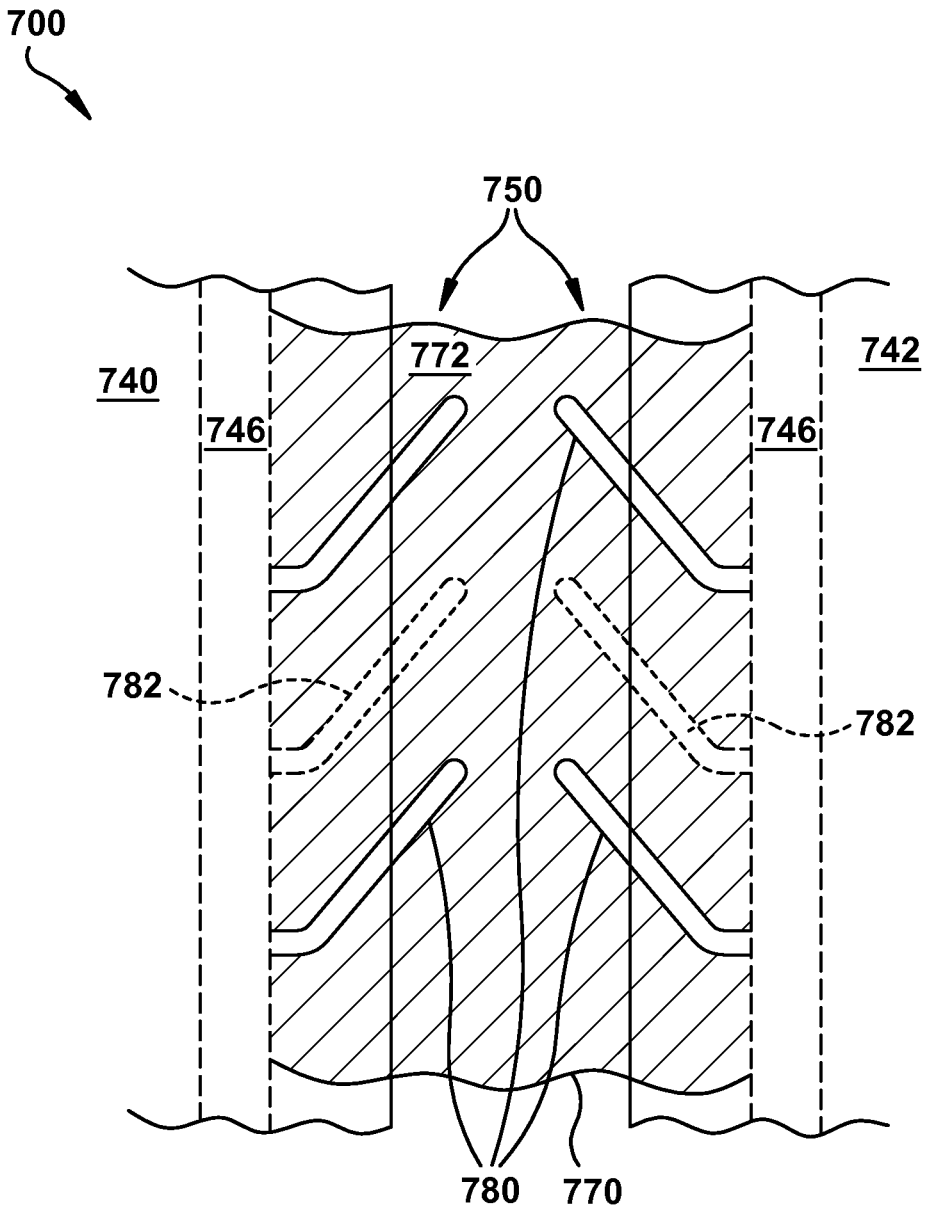
FIG. 9 shows a partial cross-sectional view of a seal element disposed between turbine components in accordance with an embodiment of the invention.

Turning to FIG. 9, a top view of a seal element 770 disposed across an interface gap 750 between a first turbine component 740 and a second turbine component 742 is shown in accordance with embodiments of the invention. In this embodiment, a first set of angled features 780 are disposed in a coolant facing surface 772 of seal element 770 and a second set of angled features 782 (shown in phantom) are disposed in a working fluid facing surface of seal element 770. Set of angled features 780 and 782 may fluidly connect interface gap 750 and a set of channels 746 disposed in turbine components 740 and 742. In one embodiment, set of angled features 780 and 782 may allow coolant flow to pass from coolant facing surface 772 into the flowpath of a steam turbine. In an embodiment, first set of angled features 780 may be staggered relative to second set of angled features 782.

Figure 10:
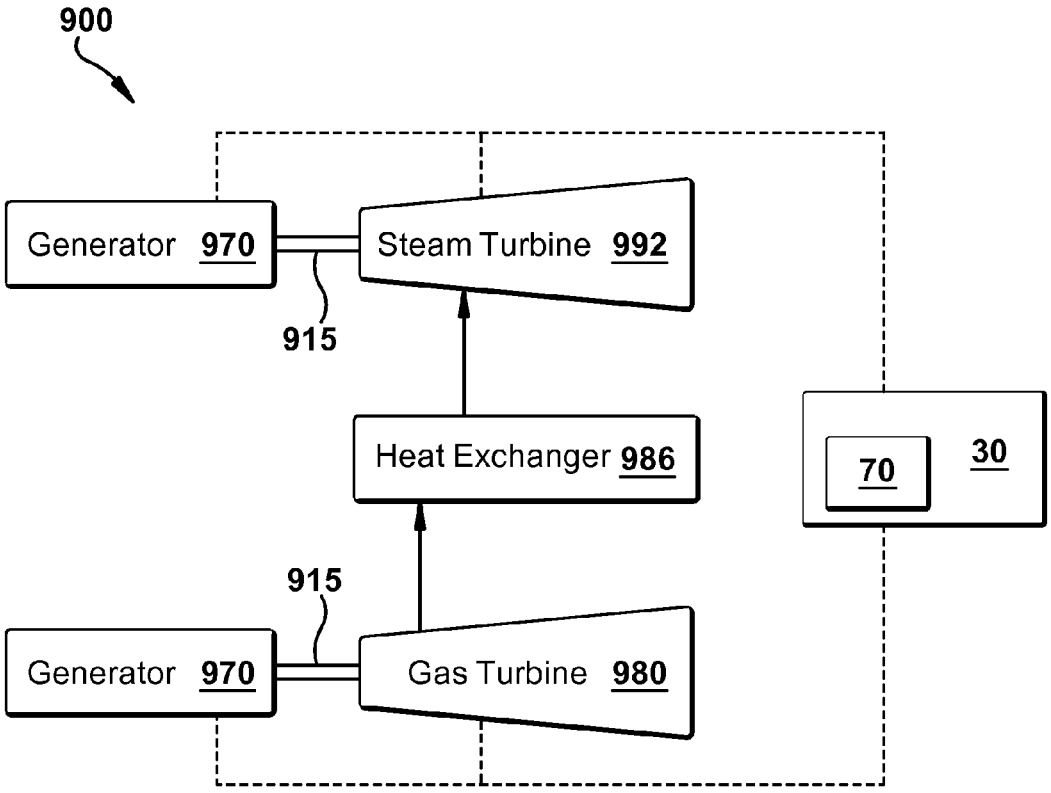
FIG. 10 shows a schematic block diagram illustrating portions of a combined cycle power plant system according to embodiments of the invention.
Figure 11:
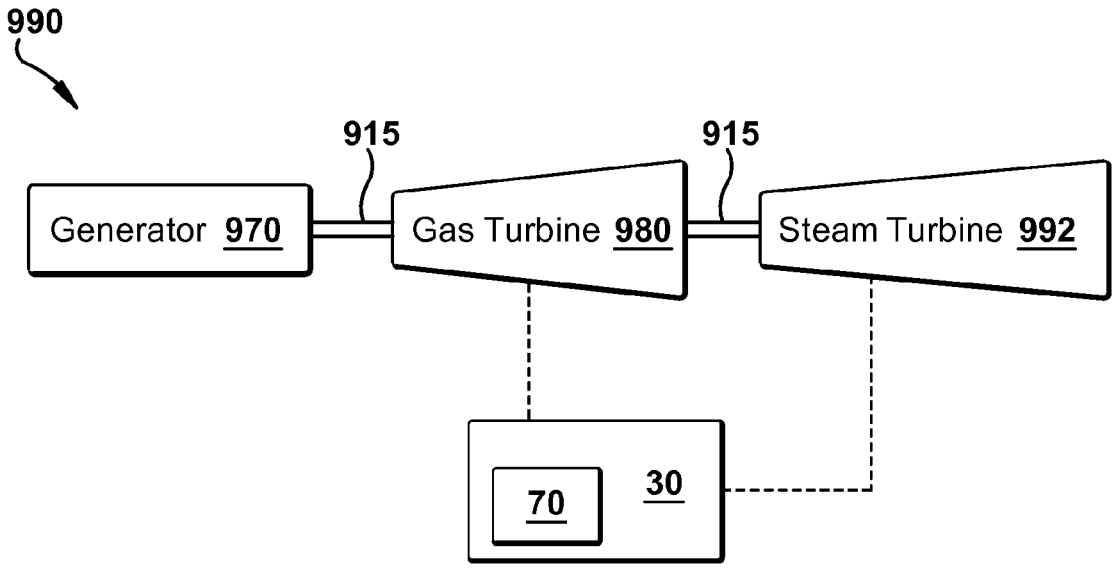
FIG. 11 shows a schematic block diagram illustrating portions of a single-shaft combined cycle power plant system according to embodiments of the invention.

Turning to FIG. 10, a schematic view of portions of a multi-shaft combined cycle power plant 900 is shown. Combined cycle power plant 900 may include, for example, a gas turbine 980 operably connected to a generator 970. Generator 970 and gas turbine 980 may be mechanically coupled by a shaft 915, which may transfer energy between a drive shaft (not shown) of gas turbine 980 and generator 970. Also shown in FIG. 10 is a heat exchanger 986 operably connected to gas turbine 980 and a steam turbine 992. Heat exchanger 986 may be fluidly connected to both gas turbine 980 and a steam turbine 992 via conventional conduits (numbering omitted). Gas turbine 980 and/or steam turbine 992 may be connected to seal element 70 of FIG. 2 or other embodiments described herein. Heat exchanger 986 may be a conventional heat recovery steam generator (HRSG), such as those used in conventional combined cycle power systems. As is known in the art of power generation, HRSG 986 may use hot exhaust from gas turbine 980, combined with a water supply, to create steam which is fed to steam turbine 992. Steam turbine 992 may optionally be coupled to a second generator system 970 (via a second shaft 915). It is understood that generators 970 and shafts 915 may be of any size or type known in the art and may differ depending upon their application or the system to which they are connected. Common numbering of the generators and shafts is for clarity and does not necessarily suggest these generators or shafts are identical. In another embodiment, shown in FIG. 11, a single shaft combined cycle power plant 990 may include a single generator 970 coupled to both gas turbine 980 and steam turbine 992 via a single shaft 915. Steam turbine 992 and/or gas turbine 980 may be connected to seal element 70 of FIG. 2 or other embodiments described herein.

The systems and devices of the present disclosure are not limited to any one particular turbine, power generation system or other system, and may be used with other power generation systems and/or systems (e.g., combined cycle, simple cycle, nuclear reactor, etc.). Additionally, the systems and devices of the present invention may be used with other systems not described herein that may benefit from the sealing and coolant distribution of the systems and devices described herein.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A seal element shaped to be disposed between static components of a turbine, the seal element comprising:

a first surface oriented toward a pressurized cavity of the turbine;

a second surface oriented substantially opposite the first surface and shaped to sealingly engage a contact surface of the static components; and an angular feature disposed in the second surface, the angular feature having a first angled portion fluidly connected to the pressurized cavity of the turbine, and a second angled portion fluidly connected to the first angled portion and a flowpath of the turbine to fluidly connect the pressurized cavity and the flowpath of the turbine, wherein the first angled portion and the second angled portion are shaped to alter a direction of a flow of pressurized coolant through the angular feature, and wherein the angular feature is shaped to accelerate the flow of pressurized coolant from the pressurized cavity to the flowpath of the turbine.

2. The seal element of claim 1, wherein the angular feature comprises one of a plurality of angular features disposed on the first surface.

3. The seal element of claim 1, wherein the angular feature includes:

an entrance channel fluidly connected to the first angled portion and formed proximate an outer surface of the seal element;

and an exit channel fluidly connected to the second angled portion and configured to extend beyond a gap edge surface of the static components.

4. The seal element of claim 1, wherein the angular feature includes at least one of: a groove, an aperture, or a channel.

5. The seal element of claim 1, wherein the angular feature is further oriented at a non-parallel angle relative to a flow direction of working fluid through an interface gap between the static components.

6. The seal element of claim 1, wherein the angular feature comprises one of a plurality of angular features disposed on the first surface and arranged in at least one of: a regular pattern relative to one another or an irregular pattern relative to one another.

7. A power generation system comprising:

a turbine including:

a first static component disposed between a pressurized cavity of the turbine and a working fluid flowpath of the turbine;

a second static component disposed adjacent the first static component and between the pressurized cavity of the turbine and the working fluid flowpath of the turbine; and a seal element shaped to be disposed between the first static component and the second static component, the seal element including:

a first surface oriented radially toward the pressurized cavity of the turbine;

a second surface oriented substantially opposite the first surface and shaped to sealingly engage a contact surface of the first static component and the second static component; and an angular feature disposed in the second surface, the angular feature having a first angled portion fluidly connected to the pressurized cavity of the turbine, and a second angled portion fluidly connected to the first angled portion and a flowpath of the turbine to fluidly connect the pressurized cavity and the flowpath of the turbine, wherein the first angled portion and the second angled portion are shaped to alter a direction of a flow of pressurized coolant through the angular feature, and wherein the angular feature is shaped to accelerate the flow of pressurized coolant from the pressurized cavity to the flowpath of the turbine.

8. The power generation system of claim 7, wherein the angular feature comprises one of a plurality of angular features disposed on the first surface.

9. The power generation system of claim 7, wherein the angular feature includes:

an entrance channel fluidly connected to the first angled portion and formed proximate an outer surface of the seal element;

and an exit channel fluidly connected to the second angled portion and configured to extend beyond a gap surface of the static components.

10. The power generation system of claim 7, wherein the angular feature includes at least one of: a groove, an aperture, or a channel.

11. The power generation system of claim 7, wherein the angular feature comprises one of a plurality of angular features disposed on the first surface and arranged in at least one of: a regular pattern relative to one another or an irregular pattern relative to one another.

12. The power generation system of claim 7, wherein the angular feature is further oriented at a non-parallel angle relative to a flow direction of working fluid through an interface gap between the static components.

13. A turbine, comprising:

a stator including a first static component and a second static component, the first static component and the second static component disposed radially inboard of a pressurized cavity;

a working fluid passage substantially surrounded by the stator;

a rotor configured radially inboard of the working fluid passage; and a seal element shaped to be disposed between the first static component and the second static component, the seal element including:

a first surface oriented toward a pressurized cavity relative to the working fluid passage of the turbine;

a second surface oriented substantially opposite the first surface and shaped to sealingly engage a contact surface of the first static component and the second static component; and an angular feature disposed in the second surface, the angular feature having a first angled portion fluidly connected to the pressurized cavity of the turbine, and a second angled portion fluidly connected to the first angled portion and to a flowpath of the turbine to fluidly connect the pressurized cavity and the flowpath of the turbine, wherein the first angled portion and the second angled portion are shaped to alter a direction of a flow of pressurized coolant through the angular feature, and wherein the angular feature is shaped to accelerate the flow of pressurized coolant from the pressurized cavity to the flowpath of the turbine.

14. The turbine of claim 13, wherein the angular feature comprises one of a plurality of angular features disposed on the first surface.

15. The turbine of claim 13, wherein angular feature in the angular feature includes:

an entrance channel fluidly connected to the first angled portion and formed proximate an outer surface of the seal element;

and an exit channel fluidly connected to the second angled portion and configured to extend beyond a gap surface of the static components.

16. The turbine of claim 13, wherein the angular feature includes at least one of: a groove, an aperture, or a channel.

17. The turbine of claim 13, wherein the angular feature comprises one of a plurality of angular features disposed on the first surface and arranged in at least one of: a regular pattern relative to one another or an irregular pattern relative to one another.

* * * * *